United States Patent [19]

Kirkman

[11] Patent Number: 4,607,871

[45] Date of Patent: Aug. 26, 1986

[54] TOOL FOR HANGING BASKETS

[76] Inventor: Chester M. Kirkman, 142 Wild Orchid La., Orange Park, Fla. 32073

[21] Appl. No.: 698,684

[22] Filed: Feb. 6, 1985

[51] Int. Cl.[4] ..... A47F 13/06; A47G 7/00

[52] U.S. Cl. ..... 294/19.1; 294/24

[58] Field of Search ..... 294/19.1, 22–24, 294/27.1, 31.2; 47/1 R, 39, 40; 248/130, 133, 137, 141, 146, 149, 153, 185, 311.2, 312, 315, 318

[56] References Cited

U.S. PATENT DOCUMENTS

| | | | |
|---|---|---|---|
| 1,512,315 | 10/1924 | Sandford | 294/24 |
| 2,312,521 | 3/1943 | Bull | 294/19.1 |
| 3,936,088 | 2/1976 | Williams | 294/19.1 |
| 4,063,768 | 12/1977 | Denis | 294/19.1 |
| 4,153,286 | 5/1979 | Piper et al. | 294/19.1 |

FOREIGN PATENT DOCUMENTS

| | | | |
|---|---|---|---|
| 574212 | 7/1924 | France | 248/141 |

*Primary Examiner*—Johnny D. Cherry
*Attorney, Agent, or Firm*—Arthur G. Yeager

[57] ABSTRACT

A tool with a telescopic extensible handle for removing a hanging basket of plants from a high hook, the tool including a pivotable ring mounted in a bifurcated support attached to the end of the handle, a hook attached to one end of the support for hanging the tool when not in use, and an upwardly pointing fork for removing baskets hanging from a flexible chain. A method of removing and replacing hanging baskets employing a gimbaled support ring is also disclosed.

6 Claims, 3 Drawing Figures

TOOL FOR HANGING BASKETS

BACKGROUND OF THE INVENTION

It is well known that homes, business offices, restaurants, and many other locations where people are found are decorated with living plants. One of the favorite decorations is a hanging basket of plants. The hanging is supported from a hook or chain attached to the basket which is hung over a nail or any other convenient support above the basket. The only problem such baskets present is that they must frequently be watered, pruned, fertilized, or otherwise treated to keep the flowers and plants in a vigorous growing condition so as to provide the best appearance. Removing overhead baskets from their high location requires a ladder and considerable time. A tool is needed to obviate the need for a ladder.

The prior art has made some attempts to solve this problem, but none is truly the answer to this problem. In U.S. Pat. No. 4,063,768 to Denis there is shown a tool with a rigid supporting ring, that may be placed under and around a hanging basket. The rigid structure makes it very difficult to retrieve a basket from a high place and remove it for treatment because the handle must be kept upright or the basket may fall out of the ring. Furthermore, this tool works only with a rigid hook structure attached to the basket. U.S. Pat. No. 4,153,286 shows an elongated handle with a fork structure at the end of the handle to engage the hook, eye or other member which is attached to the ceiling hook for supporting the basket. This tool is especially useful for handling baskets which are hung from flexible cords or chains.

It is an object of the present invention to provide an all-purpose tool for handling any type of hanging basket. It is another object to provide a tool which can maintain the hanging basket in an upright position at all times while being moved from the normal hanging position, to the floor for treatment and back again. Other objects will become apparent from the more detailed description which follows.

BRIEF DESCRIPTION OF THE INVENTION

This invention relates to a tool for handling hanging baskets comprising an elongated handle with a bifurcated yoke at one end thereof opening upward away from the handle, a ring support pivotally fastened at diametrically opposite points to the ends of said yoke to pivot inside the yoke, a first hook member attached to the outside of one arm of the yoke with the opening of the hook facing downward toward the handle, and a second hook member attached to the other arm of the yoke with the opening of the hook facing upward away from said handle.

This invention also relates to a method of removing overhead hanging baskets, bringing the baskets to ground level by swinging the handle from a vertical position to a horizontal position, treating the plant, and reversing the procedure to return the basket to its overhead hanging position.

In specific and preferred embodiments of the invention the ring support is pivotable through 360° C., the handle is telescopically extensible and retractable, and the yoke is generally semicircular in shape.

BRIEF DESCRIPTION OF THE DRAWINGS

The novel features believed to be characteristic of this invention are set forth with particularly in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

The features of the tool of this invention may be seen in the accompanying drawing. An elongated handle 10 has a basket supporting structure attached to its distal end 18. Handle 10 preferably is made of telescopically extensible and retractable sections so it may be used for any of a wide variety of heights, or alternatively, it may be made in several separate sections attachable to each other to make the handle longer or shorter.

Figure 1:
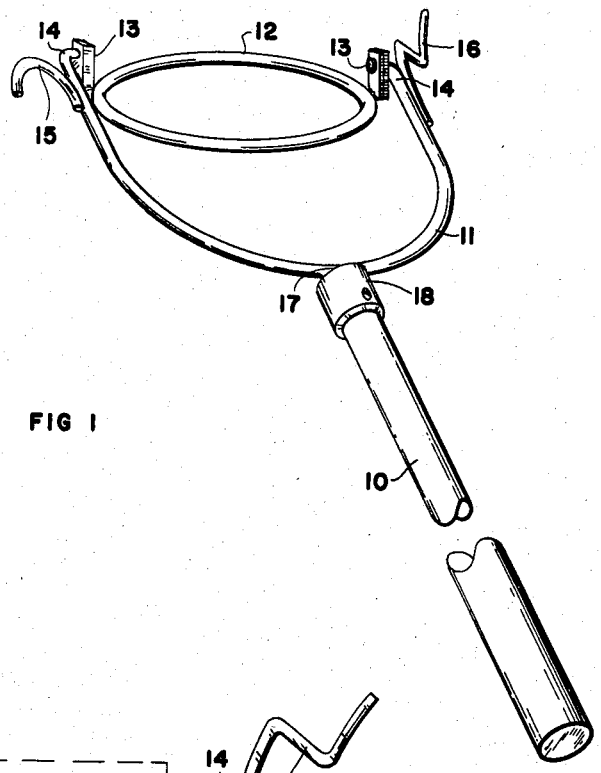
FIG. 1 is a perspective view of the tool of this invention.
Figure 2:
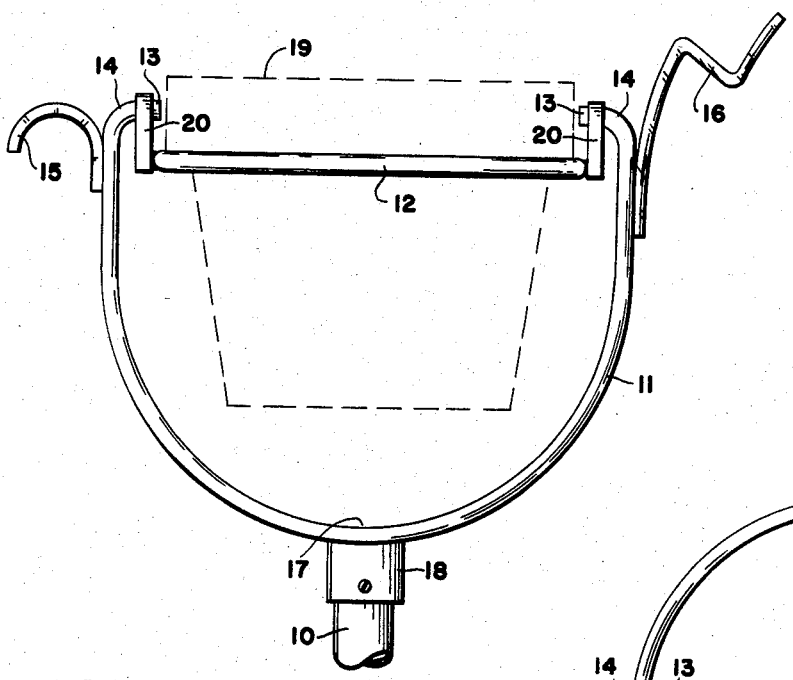
FIG. 2 is a front elevational view of the tool of this invention.
Figure 3:
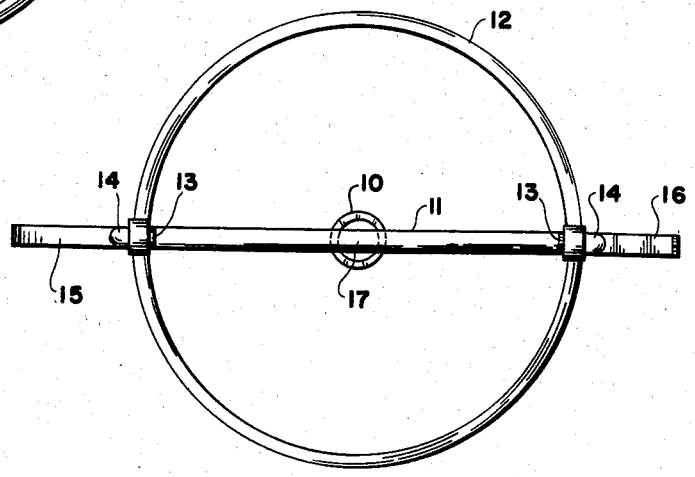
FIG. 3 is a top plan view of the tool of this invention.

Handle 10 is attached, as by welding or bolting, to the midpoint 17 of a bifurcated yoke support 11 having its two ends 14 pointing upward away from the handle. Preferably, yoke support 11 is generally semicircular in shape. Ring 12 is mounted pivotally to yoke support ends 14 by means of pivot pins 13 so that ring 12 is freely pivotable through 360° inside of yoke support 11. Ring 12 is of the appropriate size to encircle a flower pot under its top ledge as may be seen in FIG. 2 wherein a typical flower pot 19 is shown in dotted lines. The shape of yoke support 11 may be varied to fit different shapes of flower pots. For example, if the pot is deep it will be necessary to shape yoke support 11 to be longer in the direction of the handle.

On the two ends 14 of yoke support 11 are placed two types of hook members. The first hook member 15 is positioned with its open side facing downward toward handle 10. Hook member 15 is intended to be used in hanging the tool on a hook or a rod when the tool is not is use. Preferably, hook member 15 is generally semicircular in shape. The second hook member 16 is positioned with its open side facing upward away from handle 10. This hook member is used on hanging baskets which are hung by flexible cords or chains, perhaps connected to a ring which is hung from a hook. The cord, chain, or ring is caught between the arms of hook member 16 and the entire basket and its cords or chains are lifted from the supporting hook. Hook member 16 preferably is V-shaped or in the form of a fork.

Because of the various sizes and shapes of hanging baskets, it may be necessary to have more than one tool to handle the different size baskets in a single location. It also is feasible to employ one tool with a large diameter ring 12 to which can be detachably attached reduced size rings to handle smaller baskets. It is also feasible to employ rings of different shapes, e.g., rectangles, ellipses, triangles, etc., to handle baskets of different shapes.

It is, of course, preferred that the tool of this invention be light in weight and yet strong. The tool may be made of solid or tubular components although the latter are preferred for strength and lightness. Preferably, the tool is made of metal, such as steel or aluminum, or plastic such as vinyl, polyethylene, fiber-glass reinforced polyester, or the like.

With ring 12 pivotable through 360° it functions as gimbals in that the flower pot will remain upright in ring 12 regardless of the position of handle 10. This permits a pot to be lifted from a high hook moving handle 10 from a vertical position when the pot is seated in ring 12 to a horizontal position when the pot is brought to the ground with the pot remaining upright during the entire movement of handle 10. This is very convenient, particularly if, at the same time, handle 10 can be retracted telescopically, or shortened by detaching separable sections, while retrieving a basket from a high place.

A preferred arrangement is to have ring 12 suspended below pivot pins 13 in order to provide more stability for the basket being supported in ring 12. If too much of the weight of the plant and the basket is above the level of pivot pins 13 there is a possibility that the basket and plant may tip and not remain upright during the handling of the tool of this invention. If ring 12 is suspended downwardly by tabs 20 from pins 13 there is little or no chance that the basket and plant will tip over during manipulation of the tool and basket supported thereon so long as the center of gravity of the basket and its contents is below the level of pivot pins 13.

In using the tool of this invention one would stand generally under the hanging basket to be retrieved, extend the handle upwardly until the ring support 12 encircled the basket and contacted it in a supporting manner, perhaps under the collar of the basket or alternatively tightly gripping the side of the basket. The handle would be extended upwardly still farther until the basket was able to be removed from the overhead hook or nail supporting it. The handle is then rotated or swung in an arc from its generally vertical position to a generally horizontal position where the basket can be rested on a supporting surface, e.g., the ground, the floor of a building, a table or the like. During its movement from the handle in a vertical position to a horizontal position, ring support 12 pivots automatically to maintain the basket in the same upright position relative to the earth at all positions of the handle, as in gimbals. The plant can then be treated, watered, fertilized, pruned, or the like. The entire procedure is then reversed to place the hanging basket on its overhead hook. During the rotation or swinging of the handle through an arc, the handle may be extended or retracted if the handle is made of telescopically connected sections; or alternatively, if the handle is made of attachable/detachable separate sections, the handle can be made longer or shorter to accommodate the needs of the operator and the surrounding space.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what is desired to secure by Letters Patent of the United States is:

1. A tool for handling hanging baskets comprising an elongated handle with a bifurcated yoke at one end thereof opening upward away from the handle, a ring support freely pivotally fastened at diametrically opposite points to the ends of said yoke with said ring support adapted to pivot inside the yoke, a first hook member attached to the outside of one of said ends of the yoke with the opening of said first hook member facing downward toward the handle, and a second hook member attached to the other of said ends of the yoke with the opening of said second hook member facing upward away from said handle.

2. The tool of claim 1 wherein the yoke is generally semi-circular in shape.

3. The tool of claim 1 wherein the second hook member is generally V-shaped.

4. The tool of claim 1 wherein the ring support is pivotable through 360° within the yoke.

5. A tool for handling overhead hanging baskets of plants comprising an elongated tubular handle having a proximal end and a distal end with said distal end affixed to the midpoint of a generally semicircular support with its ends pointing upwardly away from said handle, a circular ring support for said baskets pivotally attached at diametrically opposite points thereon to the respective said ends of said semicircular support and adapted to freely pivot through 360° inside said semicircular support, a semicircular hook member affixed to the outside of one said end of said semicircular support with the open side of said hook member facing downwardly toward said handle, and a V-shaped fork member affixed to the outside of the other said end of said semicircular support with the open side of said fork member facing upwardly away from said handle.

6. A method of removing a hanging basket from an overhead suspension which comprises:

(1) positioning an encircling supporting band around the midsection of a basket hanging from a support above the basket, said band being freely pivotally attached to a bifurcated yoke at the end of an elongatable handle;

(2) pushing upwardly on the handle to release the basket from its support while the handle is generally in a vertical position;

(3) rotating the handle to a generally horizontal position while the basket and the encircling band remain at all times in a generally upright position;

(4) returning the basket to its original hanging support by rotating the handle to a generally vertical position and reattaching the basket to its overhead suspension; and (5) removing the encircling band from supporting the basket.

* * * * *